US006682202B2

(12) United States Patent
Wong

(10) Patent No.: US 6,682,202 B2
(45) Date of Patent: Jan. 27, 2004

(54) NOVELTY DEVICES WITH FLASHING LIGHT FEATURE

(75) Inventor: Wai Kai Wong, Kowloon (HK)

(73) Assignee: Cheerine Development (Hong Kong) Ltd. (HK)

( * ) Notice: Subject to any disclaimer, the term of this patent is extended or adjusted under 35 U.S.C. 154(b) by 0 days.

(21) Appl. No.: 10/100,621

(22) Filed: Mar. 18, 2002

(65) Prior Publication Data

US 2003/0174496 A1 Sep. 18, 2003

(51) Int. Cl.[7] ..... B43K 29/10; B43K 29/00

(52) U.S. Cl. ..... 362/118; 401/195

(58) Field of Search ..... 315/200 A, 225, 315/362; 362/103, 800, 118; 36/137; 401/195

(56) References Cited

U.S. PATENT DOCUMENTS

| | | | | | |
|---|---|---|---|---|---|
| 4,518,274 | A | | 5/1985 | Hanggi | 401/195 |
| 5,388,038 | A | | 2/1995 | Yang | 362/118 |
| 5,523,928 | A | | 6/1996 | Kim | 362/118 |
| 5,544,967 | A | * | 8/1996 | Yao | 401/195 |
| 5,617,304 | A | * | 4/1997 | Huang | 362/118 |
| 5,656,805 | A | | 8/1997 | Plesko | 253/472 |
| 5,673,996 | A | | 10/1997 | Ducker | 362/118 |
| 5,730,539 | A | | 3/1998 | Chabria | 401/195 |
| 5,735,592 | A | | 4/1998 | Shu | 362/118 |
| 5,797,926 | A | * | 8/1998 | Mehl, Sr. | 606/133 |
| 5,894,201 | A | | 4/1999 | Wong | 315/241 S |
| 5,969,479 | A | | 10/1999 | Wong | 315/200 A |
| 5,993,026 | A | * | 11/1999 | Wu | 362/259 |
| 6,065,851 | A | * | 5/2000 | So | 362/103 |
| 6,099,185 | A | | 8/2000 | Huang et al. | 401/19.5 |
| 6,104,140 | A | * | 8/2000 | Wut et al. | 315/200 A |
| 6,106,132 | A | | 8/2000 | Chen | 362/118 |
| 6,129,473 | A | | 10/2000 | Shu | 401/195 |
| 6,158,871 | A | | 12/2000 | Geddes et al. | 362/118 |
| 6,189,542 | B1 | * | 2/2001 | Shepard | 132/273 |
| 6,238,057 | B1 | * | 5/2001 | Chen | 362/118 |
| 6,261,018 | B1 | | 7/2001 | Chen | 401/194 |
| 6,443,604 | B1 | * | 9/2002 | Rudenberg | 362/488 |

FOREIGN PATENT DOCUMENTS

| | | |
|---|---|---|
| CN | 2063363 U | 10/1990 |
| CN | 2084731 U | 9/1991 |
| CN | 2096471 U | 2/1992 |
| CN | 2096910 U | 2/1992 |
| CN | 2131725 Y | 5/1993 |
| CN | 2167582 Y | 6/1994 |
| CN | 2198731 Y | 5/1995 |
| CN | 2448567 Y | 9/2001 |
| JP | 7-112596 | 5/1995 |
| JP | 10-309889 | 11/1998 |
| JP | 11-7802 | 1/1999 |
| JP | 2000-37989 | 2/2000 |

* cited by examiner

*Primary Examiner*—Don Wong
*Assistant Examiner*—Minh D A
(74) *Attorney, Agent, or Firm*—Brinks Hofer Gilson & Lione

(57) ABSTRACT

A novelty device includes a power source, lighting elements and a flashing circuit to selectively provide lighting signals to the lighting elements. The novelty device further includes a spring switch to activate the flashing circuit. The spring switch includes a spring having a fixed end and a free end and a metal cap positioned proximate the free end of the spring for electrical engagement by the free end of the spring. Examples of the novelty device include a pen, a key chain, a hair clip and a cosmetics case.

24 Claims, 10 Drawing Sheets

NOVELTY DEVICES WITH FLASHING LIGHT FEATURE

BACKGROUND

The present invention relates generally to novelty devices. More particularly, the present invention relates to novelty devices incorporating a flashing light feature.

U.S. Pat. Nos. 5,969,479 and 5,894,201 disclose light flashing systems which may be incorporated with footwear. The system includes a battery, light emitting elements, transistors, a motion switch and a pattern generating circuit. The switch responds to inertial forces to close and complete a circuit, clocking the pattern generating circuit. The systems may be incorporated in a shoe or other footwear to increase visibility of the wearer.

It has been observed that the flashing light pattern produces a pleasing display as well as improving visibility of the wearer. Because of this, it is desirable to extend the flashing light feature to other products including novelty items. However, the previous light flashing system, while well-adapted for use with footwear, presents some limitations when used with other novelty applications. For example, the design of the previous system, while sufficiently sturdy for footwear applications, may be too large for small hand-held novelty devices such as pens. Accordingly, there is a need for an improved method and apparatus providing novelty devices with a flashing light feature.

BRIEF SUMMARY

By way of introduction only, a novelty device includes a power source, lighting elements and a flashing circuit to selectively provide lighting signals to the lighting elements. The novelty device further includes a, motion switch such as a spring switch and metal ball switch to activate the flashing circuit. The spring switch includes a spring having a fixed end and a free end and a metal cap positioned proximate the free end of the spring for electrical engagement by the free end of the spring.

Thus, the disclosed novelty device incorporates a light flashing system which is triggered by motion of the device causing vibration of the spring switch. Upon triggering, a control circuit applies the necessary control signals to illuminate one or more lighting elements. The lighting elements flash in a particular pattern. The flashing lights are decorative and entertaining and enhance the value of the novelty device. Also, the flashing lights improve the visibility of the novelty device for the user.

The novelty device may be embodied in any one of a wide variety of embodiments. Examples include writing instruments such as pens and personal devices such as key chains, cosmetics cases such as lipstick holders and wearable devices such as hair clips. Other exemplary embodiments include dog collars, eyeglass cases, jewelry, such as necklaces, bracelets and wands, clips for clothing, bags and backpacks and toys of all sorts. These listed embodiments are exemplary only. In these examples, the novelty device benefits from the improved visibility provided by the incorporated lighting system and its entertainment value is also enhanced.

It is a feature of the disclosed novelty devices that the light flashing system incorporated therein is sufficiently small and flexible that the system may be adapted to use for a very wide variety of applications, including small personal items.

It is a further feature of the disclosed novelty devices that, in some embodiments, the power source includes one or more batteries. The novelty device may be designed with replaceable batteries, incorporating an accessible battery compartment for removable and replacement of the batteries.

Other features and advantages of the disclosed embodiments, as well as alternative embodiments to which the concepts disclosed herein may be extended, will be evident from the following description. The foregoing discussion of illustrative embodiments of the invention has been provided only by way of introduction. Nothing in this section should be taken as a limitation on the following claims, which define the scope of the invention.

DETAILED DESCRIPTION OF THE PRESENTLY PREFERRED EMBODIMENTS

Figure 1:
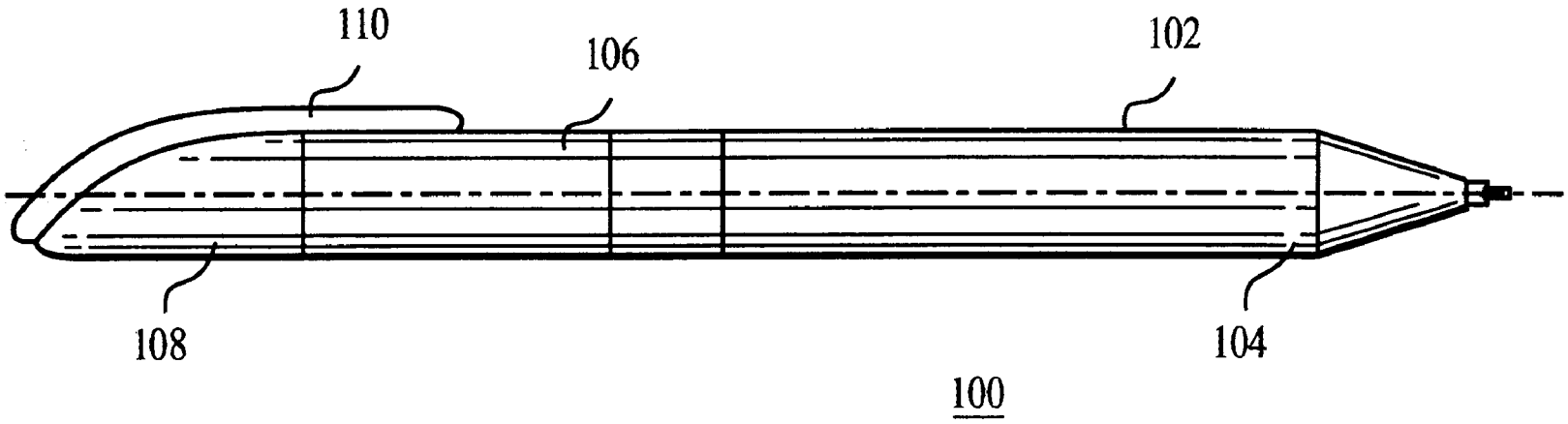
FIG. 1 is an elevation view of a first embodiment of a novelty device including a light flashing system.
Figure 2:
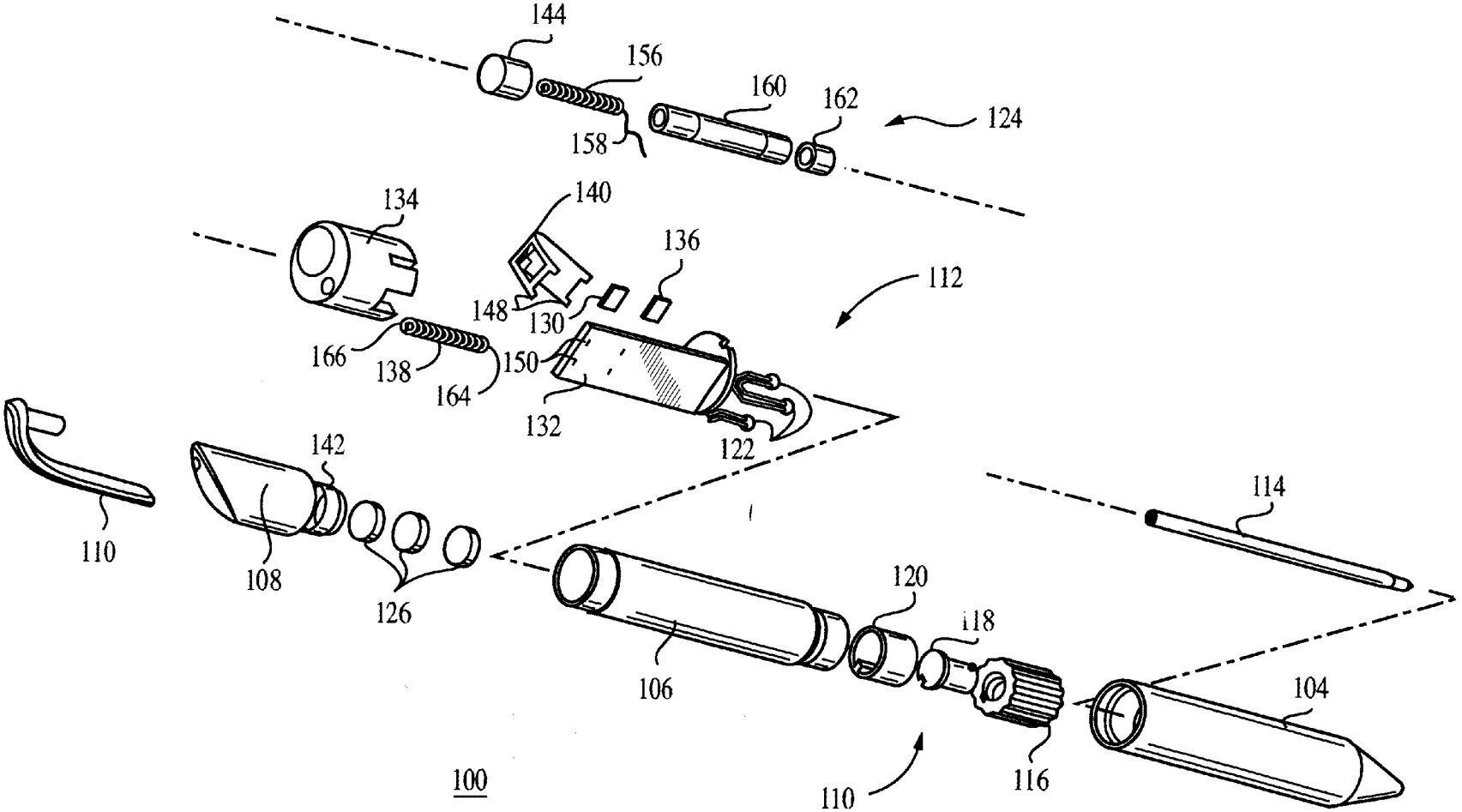
FIG. 2 is an exploded view of a first embodiment of the novelty device of FIG. 1.
Figure 3:
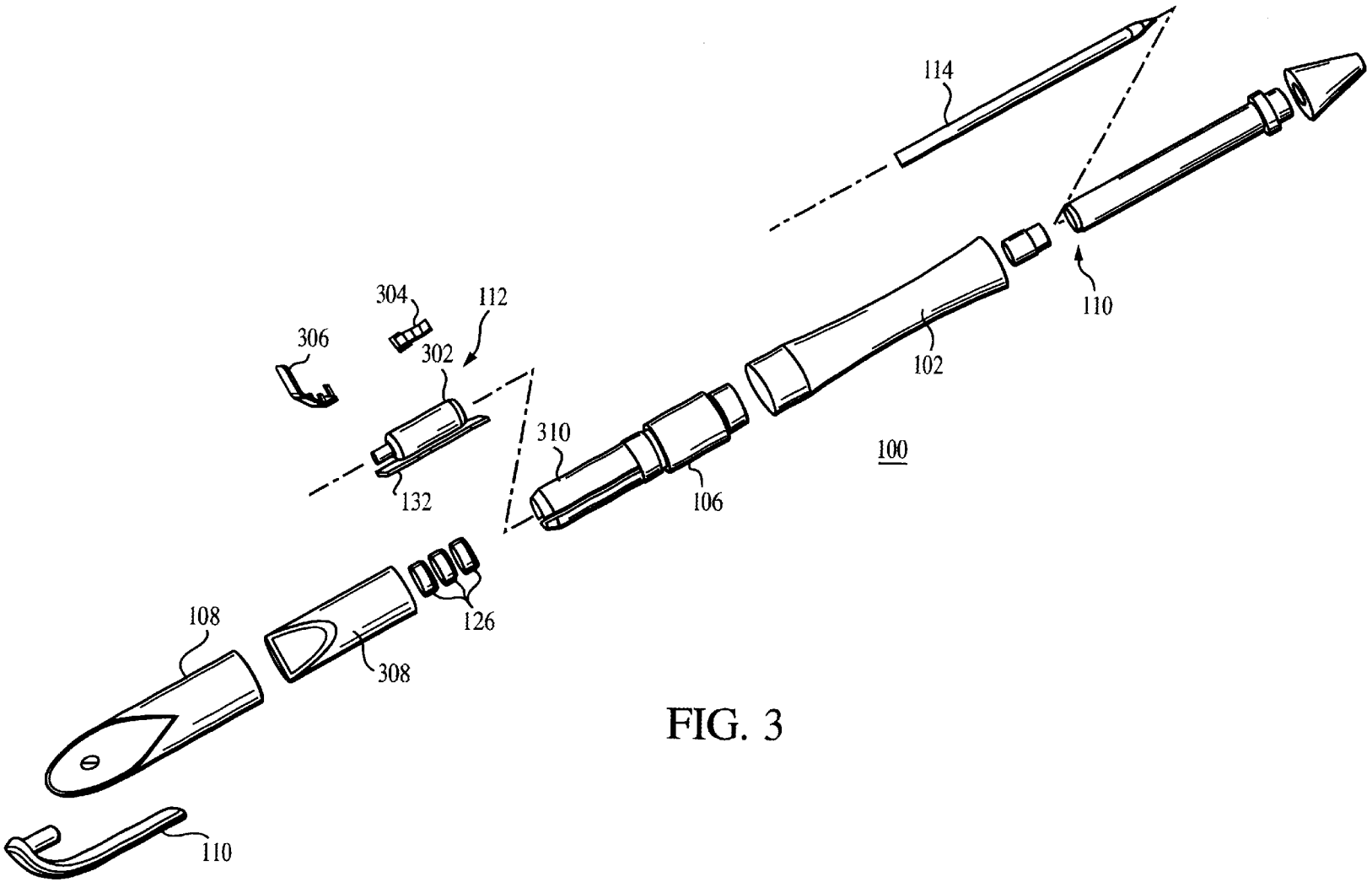
FIG. 3 is an exploded view of a second embodiment of the novelty device of FIG. 1.

Referring to the drawing, FIGS. 1–3 show views of a novelty device including a light flashing system. In the embodiments of FIGS. 1–3, the novelty device is a pen or other writing instrument. FIG. 1 is an elevational view of a first embodiment of the pen 100. FIG. 2 is an exploded view of a first embodiment of the pen 100. FIG. 3 is an exploded view of a second embodiment of the pen 100. Other embodiments of a novelty device including a light flashing system will be described below in conjunction with FIGS. 8–10.

The pen 100 includes a housing which contains the pen mechanism and a light flashing system. The housing 102 includes a pen-head casing 104, a transparency lighting casing 106, an upper casing 108 and a clip 110. The casings 104, 106, 108 may be joined in any suitable fashion. For example, the casings 104, 106, 108 may include internally and externally threaded portions which permit the casings 104, 106, 108 to be threaded together to form the housing 102. Alternatively, the casings 104, 106, 108 may include snap-fit portions which permit the casings 104, 106, 108 to be snapped together into a single housing 102. The casings 104, 106, 108 may be of any suitable material, such as plastic, metal or combinations thereof. Preferably, the transparency lighting casing 106 includes a transparent portion, which may be the entire casing 106. The transparent portion permits viewing of the illuminating lighting elements contained therein, as will be described below.

Contained within the housing 102 are a ball pen refill motion system 110 and a light flashing system 112. The ball pen refill motion system 110 is configured to advance and retract a ball pen refill 114. The ball pen refill 114 is conventional and includes a reservoir for storing ink and a ball tip for writing. In the embodiment of FIG. 2, the ball pen refill motion system 110 includes a slot-hollow cylinder 116, a central shaft 118, and a hollow cylinder 120. The ball pen refill 114 can be advanced and retracted by turning the pen head casing 102. When turning the pen head casing 102 in a clockwise direction, for example, the central shaft 118 in the ball pen refill motion system 110 will be turned in a counterclockwise direction, guided by a slot in the slot hollow cylinder 120. As a result, the ball pen refill 114 advances. On the other hand when the pen head casing 104 is turned in a counterclockwise direction, the ball pen refill 114 will be retracted. The ball pen refill motion system 110 in the embodiment of FIG. 3 provides similar functionality. In other embodiment, the ball pen refill motion system is omitted and the ball pen refill is fixed in the housing 102.

The light flashing system 112 in the embodiment of FIG. 2 includes lighting elements 122, a spring switch assembly 124 and batteries 126 and a circuit including one or more integrated circuits 130, a printed circuit board 132, a battery casing 134, a resistor 136, a spring 138, a metal plate 140, and a metal cover 142. The integrated circuit 130 and associated devices form a flashing circuit to provide lighting signals to the lighting elements 122.

The spring switch assembly 124 includes a metal cap 144, a spring 156 having an electrical lead 158, a spring casing 160 and a plastic stand 162. Additional detail regarding assembly of an embodiment of the spring switch assembly 124 will be provided below in conjunction with FIG. 5.

The components of the light flashing system 112 are assembled by soldering or otherwise affixing electronic components to the printed circuit board 132. Thus, the light emitting elements 122, spring switch assembly 124, the integrated circuit 130, the resistor 136 and the metal plate 140 are attached to the printed circuit board 132. When assembled, one end 164 of the spring 138 is mechanically fixed on the printed circuit board 132 and another end 166 is free to directly contact the metal cover 142 for electrical contact and conducting.

The printed circuit board 132 may be formed of any suitable material and may have conductive traces patterned on a surface of the printed circuit board 132. The integrated circuits 130 may be any suitable circuitry required to perform the functions described herein to produce a flashing light pattern. The integrated circuit 130 include passive devices such as resistors and capacitors as well as active devices such as transistors. Discrete devices such as resistors, capacitors and transistors may be positioned on the printed circuit board 132 as well. The metal plate 140 includes tabs 148 which match corresponding slots 150 formed in the printed circuit board 132. By engaging the tabs 148 and the slots 150, the metal plate 140 may be fastened to the printed circuit board 150. Any other suitable connection technique which provides good electrical contact among the components may be substituted.

When assembled, the spring switch assembly 124 is positioned inside the transparency lighting casing 106 so that the illuminating lighting elements 122 may be visible outside the casing 106. The spring switch assembly may be fixed within the transparency lighting casing in any suitable manner, for example by snap fitting the printed circuit board 132 to retainers (not shown) of the casing 106 or by gluing or cementing the assembly 124 in place.

The batteries 126 are positioned adjacently so that they are electrically in series. The batteries 126 form a power source for the light flashing system 112. In the illustrated embodiments, three button-shaped batteries are used. In other embodiments, other battery configurations may be substituted to accommodate the mechanical size and geometry of the housing 102 of the novelty device 100. The batteries which are provided must produce a sufficient voltage to operate the light flashing system 112. The negative terminal on the face of one battery engages mechanically and electrically the metal plate 140, which is springy or provides a mechanical bias along a major axis of the pen 100 to secure the batteries 126 within the battery casing 134. The metal cover 142 engages an end battery to provide mechanical restraint of the end battery within the battery casing 134 and provides an electrical contact between the free end 166 of the spring 138 and the positive terminal of the battery.

When using the pen 100, motion of the pen 100 imparts a force on the spring switch 124 which causes the spring 156 to vibrate in all directions. The spring switch 124 including the spring 156 activates the flashing circuit. The spring 138 electrically contacts the metal cover 142, completing a circuit between the batteries 126, the metal plate 140 and the spring 138. Current flows in the completed circuit, triggering the light flashing system 112 including the integrated circuits 130. As the spring 156 touches the metal cap 144, the spring switch 124 closes and a signal is generated. As a result, the integrated circuits 130 are actuated and produce a flashing pattern. Further description of this process will be provided hereinbelow.

The light flashing system 112 illustrated in the embodiments of FIGS. 1 and 2 has been adapted for use in a novelty device such as the pen 100. The physical geometry and dimensions of the light flashing system 112 are suitable for inclusion even in the small space defined by the transparency lighting casing 106 or similar housing components of other novelty devices. The components of the light flashing system 112 are rigidly formed and integrated to produce a system which is sufficiently rugged for novelty applications. In some embodiments, the batteries 126 may be replaced, extending the life of the novelty device. The batteries may be removed by removing the upper casing 108 and the battery casing 134 to expose the batteries 126. Identical or similar batteries may be substituted when the batteries 126 lack sufficient stored charge to operate the light flashing system 112. Other embodiments do not feature replaceable batteries, for example, to reduce manufacturing cost, or feature rechargeable batteries.

It is a feature of the light flashing system 112 that the sensitivity of the switch 124 can be adjusted by varying the separation distance between the spring 156 and the metal cap 144. The sensitivity of the switch 124 can also be adjusted by varying the length of the spring 156. For example, when the separation distance between the spring 156 and the metal cap 144 increases, the sensitivity of the switch 124 decreases. When the length of the spring 156 increases, the sensitivity of the switch 124 increases. Also, when the stiffness of the spring 156 increases, the sensitivity of the switch 124 decreases.

In the embodiment of FIG. 3, another motion switch 302, a metal bracket 304, and a battery bracket 306 are mountable on the printed circuit board 132. The battery bracket 306 engages the batteries 126. The battery bracket 306 is bent or otherwise formed to produce a mechanical bias to maintain a sure electrical contact with the batteries 126. The light flashing system 112 is positioned within the interior of the transparency lighting casing which preferably includes a transparent portion for viewing of flashing lighting elements. A battery cover 308 engages an outside portion of the transparency lighting casing 106. The battery cover is preferably removable to permit replacement of the batteries 126.

The novelty device 100 of FIGS. 1–3 is exemplary of novelty devices in which a flashing light system may be incorporated. In other embodiments, the novelty device may be embodied as a hair clip, a cosmetics case or a key chain. These alternative embodiments are exemplary only. Other exemplary embodiments include dog collars, eyeglass cases, jewelry, such as necklaces, bracelets and wands, ornamental clips for clothing, bags and backpacks and toys of all sorts. The novelty device may be embodied as any device in which the illumination, decorative and entertainment value of a flashing light system such as the disclosed flashing light system, may be incorporated.

Figure 4:
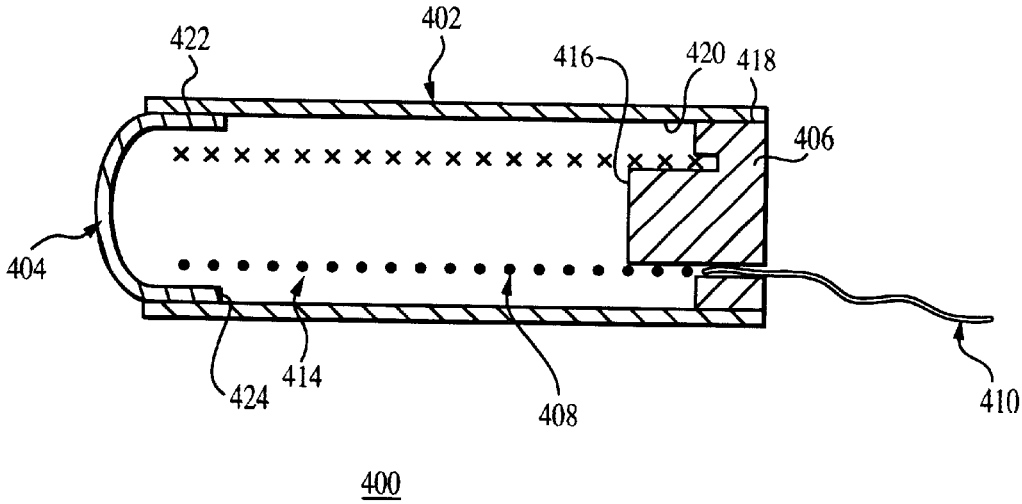
FIG. 4 is a cross section view of a spring switch for use in the novelty device of FIG. 1.
Figure 5:
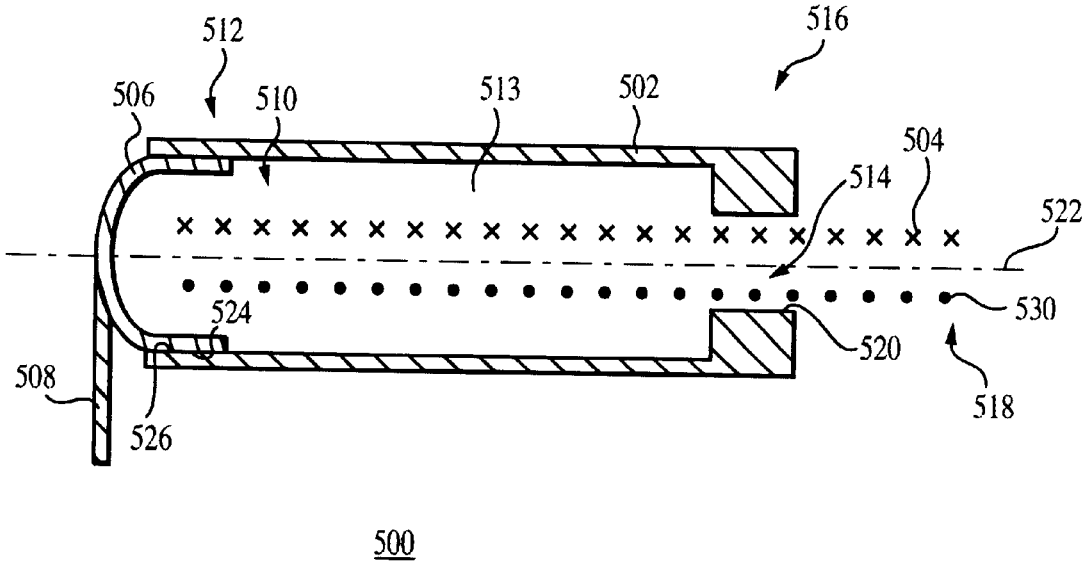
FIG. 5 is a cross section view of another spring switch for use in the novelty device of FIG. 2.

FIG. 4 is a cutaway view of a spring switch assembly 400 for use in conjunction with the novelty devices described herein in FIG. 2. FIG. 5 is a cross section view of the spring switch of FIG. 3. The spring switch assembly 400 includes a spring casing 402, a metal cap 404, a plastic stand 406, a spring 408, and an electrical lead 410 for the spring 408.

The spring 408 is contained within a void 414 within the spring casing 402. The void 414 is closed at one end by the plastic stand 406 and at the second end by the metal cap 404. The spring 408 is mounted on or otherwise retained by the plastic stand 406, which, in the illustrated embodiment includes a boss 416 centrally located on the plastic stand for mounting the spring 408. The end of the spring 408 may be flexed or twisted onto the boss 416, may be glued to the boss 416 or otherwise attached to the boss or the plastic stand 406. The spring 408 is preferably made of metal wire or other conductive material and its length and flexibility, rigidity or spring constant can be chosen to tailor the sensitivity of the switch spring switch assembly 400 as described herein.

The outer perimeter 418 of the plastic stand 406 is sized to snugly engage the inner perimeter 420 of the spring casing 402. Similarly, the outer perimeter 422 of the metal cap 404 is sized to snugly engage the inner perimeter 424 of the spring casing 402 at the second end of the spring casing 402. In other embodiments, the ends of the void 414 may be left open or may be sealed for example by gluing the metal cap 404 and plastic stand 406 in place.

An electrical lead 410 is in electrical contact with the spring 408. In one embodiment, the electrical lead 410 is the tail of the spring 408 and forms a terminal of the switch 400. Similarly, the metal cap 404 forms another terminal of the switch 400. These leads 410, 412 may be soldered or otherwise electrically contacted to the printed circuit board other circuitry of the light flashing system with which the spring switch assembly 400 is used.

When a novelty device including the spring switch assembly 400 is used, the spring 408 vibrates within the spring casing 402. The free end of the spring 408, away from the plastic stand 406, is free to vibrate, mechanically and electrically contacting the metal cap 404. As the spring 408 touches the metal cap 404, the spring switch including the spring switch assembly 400 closes electrically, completing an electrical circuit which includes the spring switch assembly 400.

Similar to the spring switch described above in conjunction with FIGS. 1–3, the sensitivity of the spring switch assembly 400 can be adjusted by varying separation distance between the spring 408 and the metal cap 404. This can be done by varying the inner diameter of the metal cap 404 or the coil diameter of the spring 408. When the separation distance between the spring 408 and the metal cap 404 increases, sensitivity of the spring switch assembly 400 decreases. Also, to vary the sensitivity of the spring switch assembly 400, the length of the spring can be varied. If the length of the spring 408 increases, the sensitivity of the spring switch assembly 400 also increases. Also, stiffness of the spring 408 can be adjusted so that increasing stiffness of the spring decreases sensitivity of the spring switch assembly 400. The sensitivity corresponds to the inertial force or vibration that must be imposed on the novelty device which includes the spring switch assembly 400 to cause the switch to close electrically, completing a circuit which includes the spring switch assembly 400.

FIG. 5 is a cross section view of a spring switch assembly 500 for use in conjunction with the novelty devices described herein. In the embodiment of FIG. 5, the spring switch assembly 500 includes a plastic housing 502, a spring 504, a metal cap 506 and a metal lead 508.

The plastic housing 502 is generally in the shape of a hollow cylinder having an opening 510 at one end 512, a hollow chamber 513 and a bore 514 at a second end 516. The spring 504 is inserted through the bore 514. The bore 514 and the spring 504 are sized so that an end 518 of the spring is retained in the bore 504. Preferably, the spring 504 is retained generally in the center of the hollow chamber 513. The spring 504 is inserted through the bore 504 to engage the inner surface 520 of the bore 514. The spring 504 may flex at it engages the inner surface 520 so that the spring 504 is retained by radially directed spring force from a center line 522 toward the inner surface 520. Alternatively, the spring 504 may be glued to the inner surface 520 or otherwise engage the plastic housing 502.

The housing 502 is preferably molded from plastic or other non-electrically conducting material. Other materials such as nylon may be substituted.

The opening 510 at the end 512 of the housing 502 is preferably sized to retain the metal cap 506 when the metal cap 506 in inserted in the opening 510. The outer surface 524 of the metal cap 506 engages the inner surface 506 of the housing 502 at the opening 510 around the perimeter of the metal cap 506. In alternative embodiments, the metal cap 506 may engage instead the outer surface of the housing 502 so long as a portion of the metal cap 506 is positioned to mechanically and electrically contact the spring 504 when the spring 504 vibrates within the hollow chamber 513.

The metal lead 508 extends from the metal cap 506 and forms one lead of the spring switch. The end 518 of the spring 504 forms a second lead or spring lead 530 of the spring switch. The metal lead 508 may be soldered or otherwise mechanically attached to other components of the circuit including the spring switch assembly 500, such as a printed circuit board. A portion of the spring 504 may be unwound and extended to form a straight lead portion as the spring lead 530 for soldering or other mechanical attachment to a printed circuit board or other circuit including the spring switch assembly 500. Alternatively, a lead element such as a wire may be soldered or otherwise attached to the spring 504 to form the spring lead 530 for electrical connection of the spring switch assembly to a circuit.

In operation, the spring 504 is maintained in a static position generally along the centerline 522 of the hollow chamber 513, as illustrated in FIG. 5. When a suitable force is applied to the spring switch assembly 500, the spring deflects from its static position. If a sufficient force is applied, the spring 504 contacts the metal cap 506, closing the switch formed by the spring switch assembly 500. When the switch is closed, an electrical path is completed between the metal lead 508 and the spring lead 530. The electrical path is completed only momentarily until the spring 504 flexes back toward its static position.

The sensitivity of the spring switch assembly 500 may be adjusted using any of the design techniques described above in conjunction with FIG. 4. These include, for example, varying the composition of the spring 504, the distance between the spring 504 and the metal cap 506 and the length of the spring 504.

In the illustrated embodiments, the housing 502 and metal cap 506 are preferably round in cross section when viewed along the centerline 522. This makes the sensitivity of the spring generally equivalent to forces applied from all radial directions. Alternatively, the cross section of the metal cap 506, the housing 502 or the spring 504 may changed in shape to, for example, a triangular or square cross section. This can be done to tailor the sensitivity or performance of the spring switch assembly 500 for a particular application.

Figure 6:
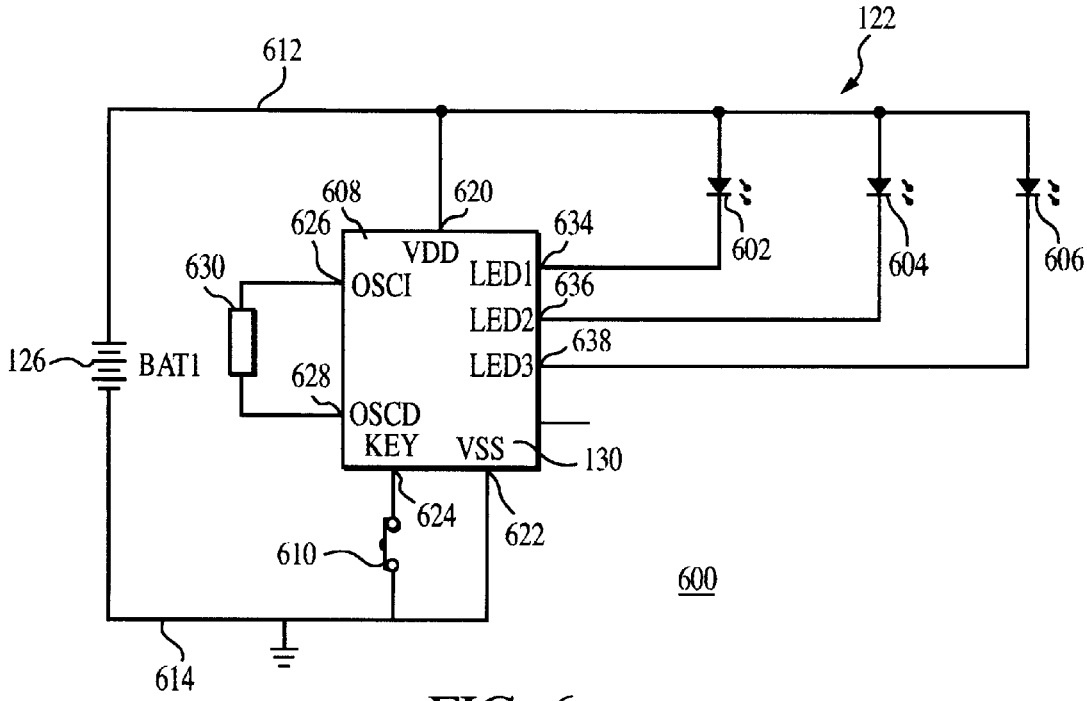
FIG. 6 is a schematic diagram of light switching circuit for use in the novelty device of FIG. 1.

FIG. 6 is a portion of the light flashing system 112 of a novelty device such as the novelty device 100 of FIG. 1. FIG. 6 illustrates a control circuit for controlling illumination of the lighting elements 122 of a novelty device such as the novelty device 100 of FIG. 1, designated light emitting diodes 302, 304, 306 in FIG. 6.

The circuit 600 includes a control circuit 608, a control switch 610 and light emitting diodes 602, 604, 606. The battery 126 of the light flashing system 112 (FIG. 1) provides operating power to a positive node 612 and a ground connection to a ground node 614. The control circuit 608 is preferably embodied as a custom designed integrated circuit or an applications specific integrated circuit (ASIC). This circuit 608 implements all the functions necessary to control flashing of the light emitting diodes 602, 604, 606. The control circuit 608 includes a power input 620 coupled to the positive node 612 and a ground input 622 coupled to the ground node 614. The control circuit 608 further includes a key input 624 coupled to the switch 124. The circuit 608 further includes oscillation control inputs 626, 628. A resistor 630 is coupled between these inputs 626, 628. The control circuit 608 still further includes LED control outputs 634, 636, 638 coupled to emitting diodes 602, 604, 606, respectively.

Upon actuation of the switch 610, the key input 624 is electrically coupled to the ground node 614. This triggers operation of the control circuit 608. In the preferred embodiment, the function of the switch 610 is provided a spring switch assembly such as the switch 124 of FIG. 2 or the assembly 400 of FIG. 4.

In response to actuation at the key input 624, the control circuit 608 provides appropriate signals at the outputs 634, 636, 638 to illuminate the light emitting diodes 602, 604, 606 sequentially, in a particular pattern. To illuminate one of the diodes, one of the outputs 634, 636, 638 is switched to a logic zero potential, allowing current to flow through the diode from the positive node 612 to the respective output. To turn off an illuminated LED, the respective output is switched to a logic high level.

As a result of the operation of the circuit 608, a special flashing pattern of the LEDs 602, 604, 606 is obtained. The sequence of this special flashing pattern changes in correspondence with the intermittent closures of the switch 610, for example due to vibration of a spring of the spring switch assembly 400 (FIG. 4). The external resistor 630 is used to adjust the oscillating frequency of the control circuit 608 so that a wide range of oscillating frequency of flashing pattern can be obtained.

Figure 7:
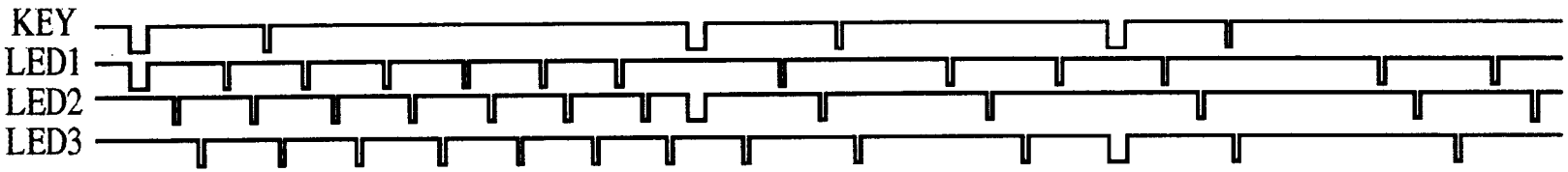
FIG. 7 is a timing diagram illustrating signals in the light switching circuit of FIG. 6.

FIG. 7 is a timing diagram illustrating input and output voltages in the control circuit 600 of FIG. 6. A voltage signal labeled key corresponds to the signal applied to the key input 624. This signal generally has a logic high level. The signal is grounded or has a logic low level whenever the switch 610 is closed. In the exemplary operation shown in FIG. 7, the occurrence and duration of actuations of the signal at the key input 624 vary more or less randomly as would be the case where the switch 610 includes a spring switch of the type described herein. Also in FIG. 7 the voltage signals labeled LED 1, LED 2, and LED 3 correspond to the signals at the outputs 634, 636, 638 of the control circuit 608 in FIG. 6. These output signals generally have a logic high level, corresponding to a respective light emitting diode being turned off or not illuminated. Intermittently, each output signal is driven to a logic low state, corresponding to illumination of a respective LED. The timing of the respective high to low transitions of the output signals is controlled by the control circuit 608.

The control circuit 608 may implement the functionality described in U.S. Pat. No. 5,969,479. Alternatively, the control circuit 608 may implement other functionality to control the output signals and illumination of the LEDs 602, 604, 606. Design and implementation of such control circuitry is well within the purview of those ordinarily skilled in the art.

Figure 8:
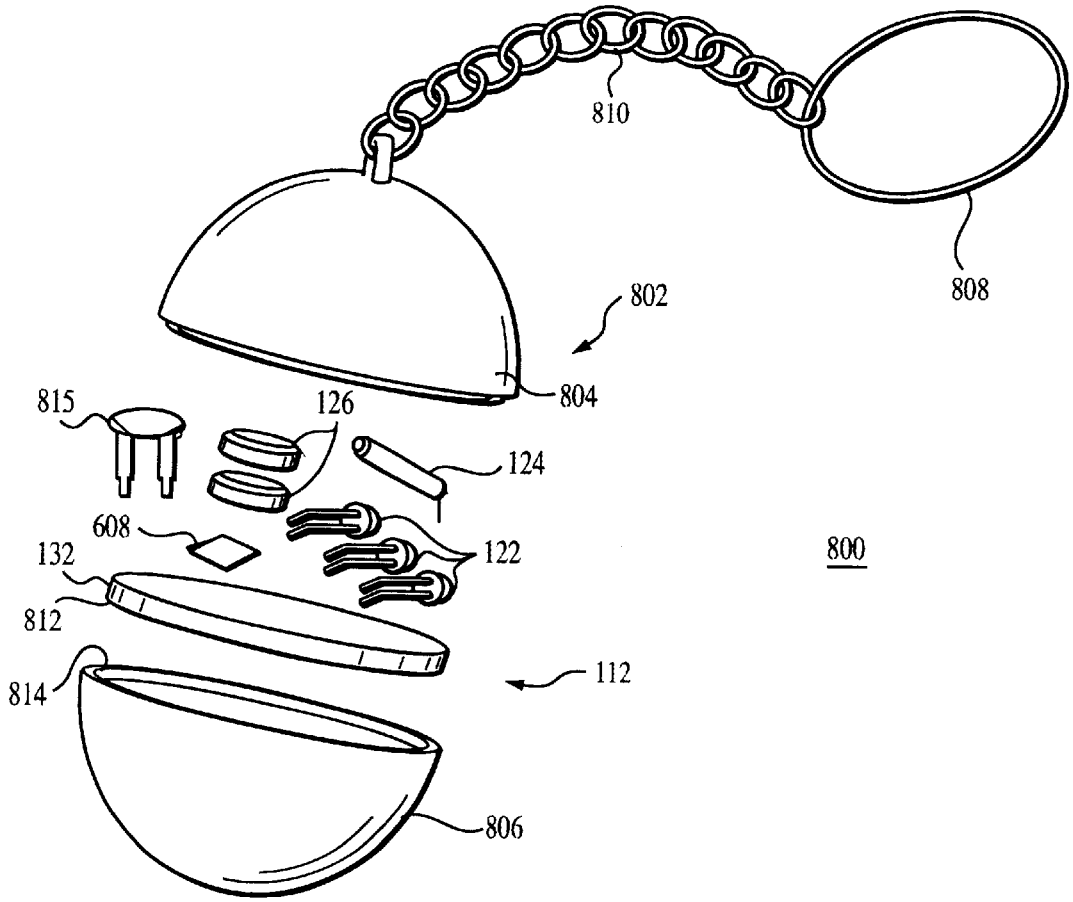
FIG. 8 is an exploded view of a second embodiment of a novelty device including a light flashing system.

FIG. 8 is an exploded view of a third embodiment of a novelty device 800 including a light flashing system. In the embodiment of FIG. 8, the novelty device 800 is embodied as a key fob or keychain. The novelty device 800 includes a housing 802 including an upper housing portion 804 and a lower housing portion 806. The novelty device 800 further includes a key ring 808 and a keychain 810 including a plurality of links linking the key ring 808 and the housing 802.

In FIG. 8, the housing 802 is shown with the housing portions 804, 806 separated to illustrate the light flashing system 112 contained within housing 802. The light flashing system 112 is preferably similar to the light flashing system 112 of FIG. 1. The light flashing system 112 includes a plurality of lighting elements 122, a spring switch assembly 124, batteries 126, a metal battery holder 815, an integrated circuit 608 such as the integrated circuit 608 of FIG. 6 and a printed circuit 132.

The components of the light flashing system have been modified mechanically to accommodate installation in the housing 802. In the illustrated embodiment, the printed circuit board 132 has an outer perimeter 812 shaped to match the inner perimeter 814 of the lower housing portion 806. In this manner, the printed circuit board 132 including the other components of the light flashing system 112 can be snap fit or fastened into the lower housing portion 806. Preferably, all or a portion of the housing, such as upper housing portion 804, is transparent to permit viewing of the light emitting diodes 122 within the novelty device 800.

Preferably, the light flashing system 112 operates in accordance with the other embodiments described herein. The spring switch assembly 124 operates to intermittently actuate a control circuit including the integrated circuit 608 to selectively illuminate the light emitting diodes in a particular decorative or entertaining pattern. The spring switch assembly 124 includes a spring forming a spring switch, as described above, for example, in connection with FIGS. 4 and 5, so that the operation of the controlled circuit is in response to inertial forces applied to the novelty device 800. Operating power is provided for the control circuit by the batteries 126. In accordance with one embodiment, the housing portions 804, 806 may be separated so that the batteries 126 may be replaced, extending the functional life time of the novelty device 800.

Figure 9:
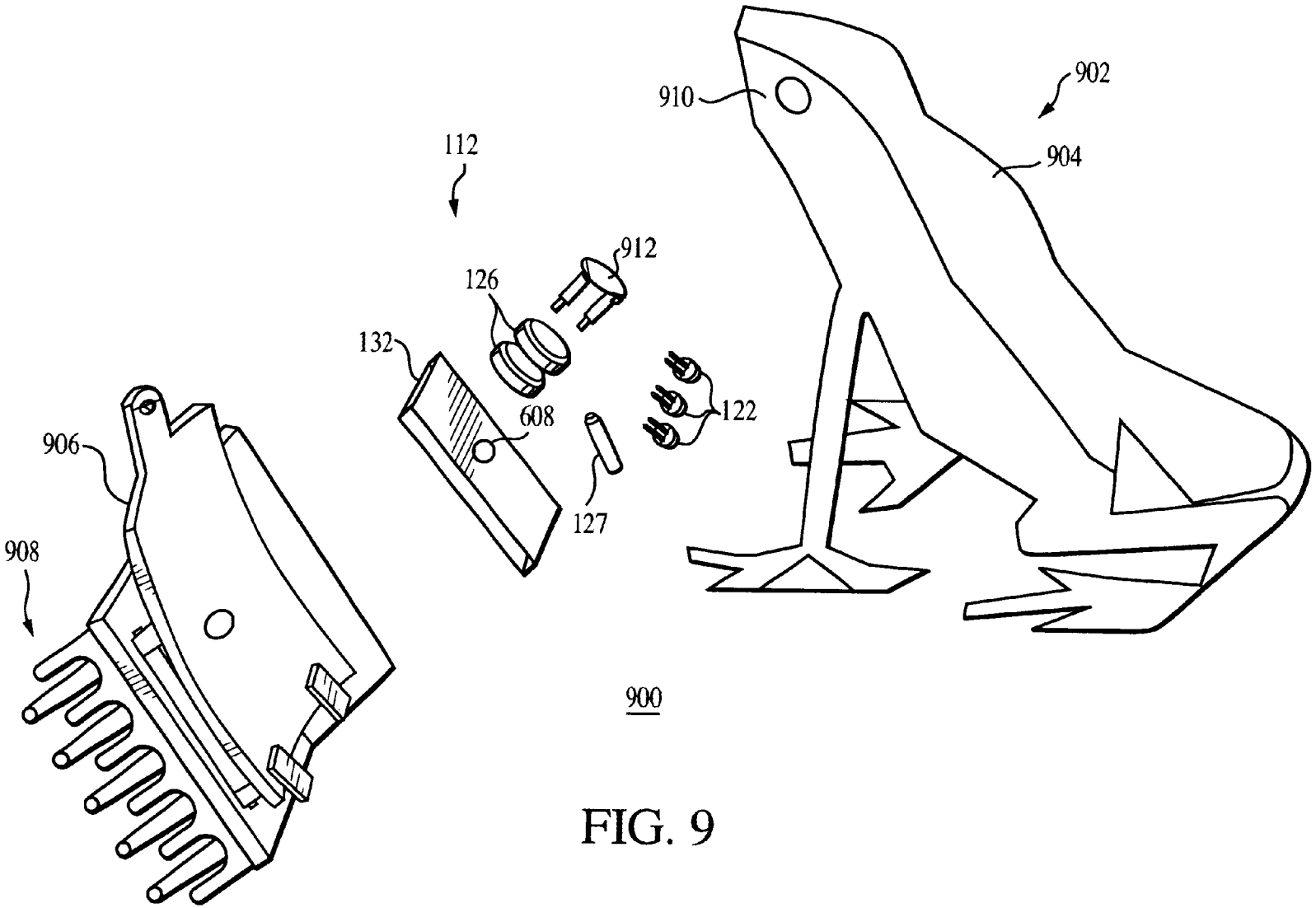
FIG. 9 is an exploded view of a third embodiment of a novelty device including a light flashing system.

FIG. 9 is an exploded view of the third embodiment of the novelty device 900 including a light flashing system 112 of the type described herein. In the illustrated embodiment, the novelty device 900 is embodied as a hair clip in the shape of a frog. The novelty device includes a housing 902 including first housing portion 904 and second housing portion 906. The light flashing system 112, including a printed circuit board having a spring switch assembly 124, light emitting diodes 122, a metal battery holder 912, integrated circuit 608 and batteries 126 mounted thereon is contained within a cavity of the first housing portion 904. The cavity is closed by combining the second housing portion 906 with the first housing portion 904. The second housing portion 908 includes a hair engaging portion 908 which may be, for example, a comb or a spring loaded hair gripper. In this manner, the novelty device 900 may be worn in the hair of a wearer and provide entertaining decoration for the wearer. The light emitting diodes 122 are preferably visible through a transparent portion of the housing 902. For example, two or more light emitting diodes 122 may be positioned at the eyes 910 of the frog embodied by a novelty device 900. Alternatively, a transparent portion of the first housing portion may provide visibility of the light emitting diodes 122.

Figure 10:
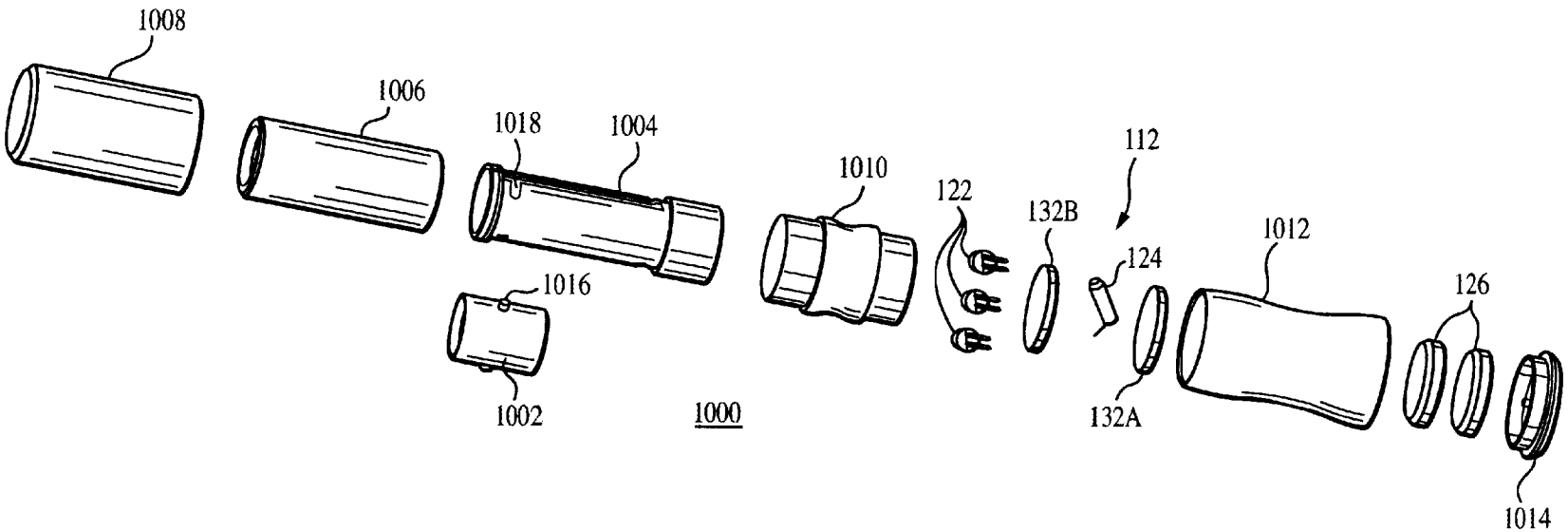
FIG. 10 is an exploded view of a fourth embodiment of a novelty device including a light flashing system.

FIG. 10 is an exploded view of a fourth embodiment of a novelty device 100 including a light flashing system 112. In the embodiment of FIG. 10, the novelty device 1000 is embodied as a cosmetics case, in particular a lipstick.

The novelty device 1000 includes a lipstick holder 1002, a lipstick motion controller 1004, a lipstick holder cover 1006, a lipstick cover 1008, a lipstick transparency housing 1010, a lipstick component holder 1012 and a lipstick battery cover 1014. A lipstick (not shown) of a suitable cosmetically approved material may be mounted in the lipstick holder 1002 which forms a cosmetic containing portion. Tabs 1016 on the outside of the lipstick holder 1002 engage slots 1018 of the lipstick motion controller 1004 to permit extension and retraction of the lipstick. The lipstick holder cover contains and protects the body of the lipstick. The lipstick cover 1008 covers the lipstick when not in use, engaging the outer surface of the lipstick holder cover 1006.

A portion of the light flashing system 112, such as light emitting diodes 122, is positioned within the lipstick transparency housing 1010 so that the lighting elements 122 which may be light emitting diodes may be viewed through transparent portions of the lipstick transparency housing 1010. The light flashing system 112 further includes other components of the type described herein for providing the light flashing function. These components include a spring switch assembly 124, printed circuit boards 132A, 132B and batteries 126. In the illustrated embodiment, the batteries 126 are maintained within a portion of the lipstick component holder 1012, in a compartment closed by the lipstick battery cover. Preferably, the lipstick battery cover 1014 maybe removed to permit replacement of the batteries 126.

As is illustrated by the embodiment of FIG. 10, the light flashing system is preferably flexible in design. Since the lipstick component holder 1012 is narrow in diameter and may be too narrow to accommodate an embodiment of the light flashing system as shown in FIGS. 1–3, in the embodiment of FIG. 10, the components of the light flashing system are shared among two printed circuit boards 132A, 132B. Appropriate electrical connections may be made between the two printed circuit boards 132A, 132B and to the batteries 126 to ensure proper functionality of the light flashing system.

While the cosmetics case embodiment of the novelty device has been illustrated as a lipstick, the principles described herein may be extended to other types of cosmetics cases. The components of the light flashing system may be adapted to a wide variety of cosmetics cases, including compacts, eye shadow and mascaras. Inclusion of a light flashing system of the type illustrated herein increases the visibility and desirability of a novelty device and makes such a device more marketable.

From the foregoing, it can be seen that the present embodiments provide a novelty device including a light flashing system. The novelty device may be embodied in any of a wide range of configurations. Generally, the novelty device includes a housing and a light flashing system. The light flashing system in the illustrated embodiments includes a spring switch to activate a flashing circuit. The flashing circuit drives lighting elements which are visible to a user of the novelty device. The components of the light flashing system are small enough and mechanically adaptable enough to be modified to fit the widest variety of novelty devices, including, as illustrated herein, pens, key chains, hairclips and cosmetic containers, or other equivalent embodiments such as dog collars, eyeglass cases, jewelry such as necklaces, bracelets and wands, clips for clothing, bags and backpacks and various types of toys. Other types of novelty devices, beyond even those illustrated or described herein, may be adapted to include the light flashing system described herein. Further, decorative elements may be applied to the exterior surface of the novelty device. Examples include a frog hair clip that is painted green and black, a pen which has a corporate logo printed thereon and a cosmetics case that has been molded and painted with a particularly appealing design.

While a particular embodiment of the present invention has been shown and described, modifications may be made. For example, other types of novelty devices, other than those shown and described herein, may be adapted to incorporate the operative and structural features described herein. It is therefore intended in the appended claims to cover all such changes and modifications which fall within the true spirit and scope of the invention.

What is claimed is:

1. A novelty device comprising:

a power source;

lighting elements;

a flashing circuit to selectively provide lighting signals to the lighting elements; and a spring switch to activate the flashing circuit in response to motion of the novelty device, the spring switch including a spring having a fixed end and a free end, a metal cap positioned proximate the free end of the spring for electrical engagement by the free end of the spring;

a spring casing having a first end and a second end and defining a void containing the spring, a plastic stand positioned to support the fixed end of the spring within the void, the plastic stand closing the first end of the spring casing, and the metal cap closing the second end of the spring casing.

2. The novelty device of claim 1 further comprising:

leads coupling the spring switch and metal cap with the flashing circuit.

3. The novelty device of claim 2 further comprising:

a housing containing the power source, the lighting elements, the flashing circuit and the spring switch.

4. The novelty device of claim 3 wherein the housing defines a pen body.

5. The novelty device of claim 4 further comprising:

a ball-pen refill; and a ball-pen refill motion system contained within the housing.

6. The novelty device of claim 4 wherein the pen body has a major axis and wherein the spring switch comprises:

a spring casing defining a void, the spring supported within the void parallel to the major axis.

7. The novelty device of claim 3 wherein the housing comprises:

a transparency-lighting casing permitting viewing of the lighting elements contained within the housing.

8. The novelty device of claim 3 wherein the housing comprises:

a battery casing which is removable to permit replacement of the power source.

9. The novelty device of claim 3 further comprising:

a key ring, the housing defining a key chain body mechanically engaging the key ring.

10. The novelty device of claim 9 wherein the housing comprises a transparent portion permitting viewing of the lighting elements.

11. The novelty device of claim 3 wherein the housing defines a hair clip body, the novelty device further comprising:

spring action hair grippers.

12. The novelty device of claim 3 wherein the housing defines a hair clip body, the novelty device further comprising:

a comb.

13. The novelty device of claim 3 further comprising:

lipstick contained within the housing; and a lipstick motion system.

14. The novelty device of claim 1 wherein the novelty device comprises one of:

a writing instrument;

a hair accessory;

a cosmetic case;

a key fob;

an eyeglass case;

a dog collar;

a necklace;

a bracelet;

a wand;

an ornamental clip; and a toy.

15. The pen of claim 14 further comprising:

lighting elements selectively illuminated by the light flashing circuit.

16. The pen of claim 15 wherein the lighting elements comprise light emitting diodes.

17. The pen of claim 15 wherein the housing comprises:

a transparency-lighting casing permitting viewing of the lighting elements contained within the housing.

18. A pen comprising:

a housing;

writing apparatus contained at least in part within the housing; and a light flashing circuit contained within the housing and including a spring switch to actuate the light flashing circuit in response to motion of the pen, the spring switch including a spring having a fixed end and a free end, a metal cap positioned proximate the free end of the spring for electrical engagement by the free end of the spring, a spring casing having a first end and a second end and defining a void containing the spring, a plastic stand positioned to support the fixed end of the spring within the void, the plastic stand closing the first end of the spring casing, and the metal cap closing the second end of the spring casing.

19. The pen of claim 18 further comprising:

batteries contained within the housing; and a housing portion removable to permit replacement of the batteries.

20. A hair accessory comprising:

a bossing;

a hair engaging portion extending from the housing; and a light flashing circuit contained within the housing and including a spring switch to actuate the light flashing circuit in response to motion of the pen, the spring switch including a spring having a fixed end and a free end, a metal cap positioned proximate the free end of the spring for electrical engagement by the free end of the spring, a spring casing having a first end and a second end and defining a void containing the spring, a plastic stand positioned to support the fixed end of the spring within the void, the plastic stand closing the fist end of the spring casing, and the metal cap closing the second end of the spring casing.

21. The hair accessory of claim 20 wherein the hair engaging portion comprises a hair gripper.

22. A cosmetic case comprising:

a housing;

a cosmetic containing portion; and a light flashing circuit contained within the housing and including a spring switch to actuate the light flashing circuit in response to motion of the pen, the spring switch including a spring having a fixed end and a free end, a metal cap positioned proximate the free end of the spring for electrical engagement by the free end of the spring, a spring casing having a first end and a second end and defining a void containing the spring, a plastic stand positioned to support the fixed end of the spring within the void, the plastic stand closing the first end of the spring casing, and the metal cap closing the second end of the spring casing.

23. The cosmetic case of claim 22 comprising one of:

a lipstick;

a compact; and a mascara.

24. A key fob comprising:

a housing;

a key ring joined to the housing; and a light flashing circuit contained within the housing and including a spring switch to actuate the light flashing circuit in response to motion of the pen, the spring switch including a spring having a fixed end and a free end, a metal cap positioned proximate the free end of the spring for electrical engagement by the free end of the spring, a spring casing having a first end and a second end and defining a void containing the spring, a plastic stand positioned to support the fixed end of the spring within the void, the plastic stand closing the first end of the spring casing, and the metal cap closing the second end of the spring casing.

* * * * *

UNITED STATES PATENT AND TRADEMARK OFFICE

CERTIFICATE OF CORRECTION

PATENT NO. : 6,682,202 B2
DATED : January 27, 2004
INVENTOR(S) : Wai Kai Wong

It is certified that error appears in the above-identified patent and that said Letters Patent is hereby corrected as shown below:

Column 10,
Line 62, immediately after "spring" delete ";" (semicolon) and substitute -- , -- (comma) in its place.

Column 12,
Line 30, delete "bossing;" and substitute -- housing; -- in its place.

Signed and Sealed this

Fourth Day of January, 2005

JON W. DUDAS
*Director of the United States Patent and Trademark Office*